US010037876B2

(12) United States Patent
Kim et al.

(10) Patent No.: US 10,037,876 B2
(45) Date of Patent: Jul. 31, 2018

(54) MASS SPECTROMETER AND METHOD FOR CONTROLLING INJECTION OF ELECTRON BEAM THEREOF

(71) Applicant: Korea Basic Science Institute, Cheongju-si, Chungcheongbuk-do (KR)

(72) Inventors: Seung Yong Kim, Daejeon (KR); Mo Yang, Daejeon (KR); Hyun Sik Kim, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 0 days.

(21) Appl. No.: 15/320,953

(22) PCT Filed: Dec. 9, 2015

(86) PCT No.: PCT/KR2015/013436
§ 371 (c)(1),
(2) Date: Dec. 21, 2016

(87) PCT Pub. No.: WO2016/108463
PCT Pub. Date: Jul. 7, 2016

(65) Prior Publication Data

US 2017/0200598 A1 Jul. 13, 2017

(30) Foreign Application Priority Data

Dec. 31, 2014 (KR) ..... 10-2014-0194552
Apr. 24, 2015 (KR) ..... 10-2015-0058163

(51) Int. Cl.
*H01J 49/00* (2006.01)
*H01J 49/08* (2006.01)
*H01J 49/42* (2006.01)

(52) U.S. Cl.
CPC ..... *H01J 49/08* (2013.01); *H01J 49/422* (2013.01)

(58) Field of Classification Search
CPC .. H01J 49/00; H01J 49/02; H01J 49/06; H01J 49/062; H01J 49/063; H01J 49/08
(Continued)

(56) References Cited

U.S. PATENT DOCUMENTS 5,659,170 A * 8/1997 Da Silveira ..... H01J 49/08 250/281
8,288,720 B2 10/2012 Taniguchi
(Continued)

FOREIGN PATENT DOCUMENTS

JP 3480409 B2 12/2003
JP 2007-527002 A 9/2007
(Continued)

OTHER PUBLICATIONS

International Search Report PCT/ISA/210 for International Application No. PCT/KR2015/013436 dated Mar. 16, 2016.

*Primary Examiner* — Jason McCormack
(74) *Attorney, Agent, or Firm* — Harness, Dickey & Pierce, P.L.C.

(57) ABSTRACT

The present invention relates to an electron bean injection control of a mass spectrometer. A mass spectrometer of the present invention includes: a reference waveform generator configured to generate a reference waveform signal having one type of a square wave and a sine wave, a waveform generator configured to generate a sync signal synchronized with the reference waveform signal; an RF module configured to generate an RF voltage signal from the reference waveform signal and apply the RF voltage signal to an RF electrode in the ion trap, an electron beam generator configured to control an operation of an ultraviolet (UV) diode for generating an electron beam injected into the ion trap
(Continued)

according to an input control signal, and a control circuit configured to generate the control signal by using the square wave signal.

17 Claims, 9 Drawing Sheets

(58) Field of Classification Search
USPC ..... 250/281, 282, 283, 286, 290, 293, 294
See application file for complete search history.

(56) References Cited

U.S. PATENT DOCUMENTS

| | | | | |
|---|---|---|---|---|
| 8,742,330 | B2 | 6/2014 | Taniguchi | |
| 9,000,364 | B2 | 4/2015 | Ermakov et al. | |
| 9,184,036 | B2 | 11/2015 | Cooks et al. | |
| 2009/0256067 | A1* | 10/2009 | Syage ..... | H01J 49/0054 250/281 |
| 2010/0072358 | A1 | 3/2010 | Jackson | |
| 2010/0084549 | A1 | 4/2010 | Ermakov et al. | |
| 2010/0123073 | A1* | 5/2010 | Guest ..... | H01J 49/0045 250/282 |
| 2012/0049059 | A1 | 3/2012 | Taniguchi | |
| 2013/0280819 | A1 | 10/2013 | Cooks et al. | |
| 2014/0264010 | A1 | 9/2014 | Riaz et al. | |

FOREIGN PATENT DOCUMENTS

| | | | |
|---|---|---|---|
| JP | 2012-243439 | A | 12/2012 |
| KR | 2001-0014034 | A | 2/2001 |

* cited by examiner (a)

(b)

MASS SPECTROMETER AND METHOD FOR CONTROLLING INJECTION OF ELECTRON BEAM THEREOF

This application is the U.S. National Phase application of PCT Application No. PCT/KR2015/013436 filed on Dec. 9, 2015, which claims priority to Korean Patent Application Nos. 10-2014-0194552, filed on Dec. 31, 2014, and 10-2015-0058163, filed on Apr. 24, 2015, the entire contents of which are hereby incorporated by reference.

TECHNICAL FIELD

The present invention disclosed herein relates to a mass spectrometry of a mass spectrometer, and more particularly, to a mass spectrometer for maximizing an amount of electrons injected into an ion trap according to electron beam injection and a method for controlling the electron beam injection thereof.

BACKGROUND ART

A mass spectrometer has a function capable of separating ionized molecules having masses at different charge ratios and may measure an ion current of each of them. In addition, the mass spectrometer may be divided into various types according to a method for separating ions.

As one of such mass spectrometers, there is a mass spectrometer for analyzing a mass using an ion trap. Such a mass spectrometer may use a cold electron ionization source as an ionization source for mass analysis, and inject an electron beam generated through the cold electron ionization source into an ion trap. At this point, the injected electron beam collides with a sample in the ion trap to generate ion molecules, and the mass spectrometer analyzes a mass using the generated ion molecules.

According to efficient generation of the electron beam, the number of the generated ion molecules and the precision of the mass analysis may be improved. However, due to positive and negative voltages periodically applied to a radio frequency (RF) electrode included in the ion trap, a phenomenon in which a part of electrons are ejected out from the ion trap occurs.

In this way, when the electrons are ejected out from the ion trap of the mass spectrometer, the precision of mass analysis is degraded. Accordingly, it is necessary to control the mass spectrometer to inject a large amount of electrons into the ion trap by the electron beam injection for precision improvement of mass analysis.

DISCLOSURE OF THE INVENTION

Technical Problem

The present invention provides a mass spectrometer for maximizing an amount of electrons injected into an ion trap according to electron beam injection and a method for controlling electron beam injection thereof.

Technical Solution

An embodiment of the present invention provides a mass spectrometer including: a reference waveform generator configured to generate a reference waveform signal having one type of a square wave and a sine wave; a waveform generator configured to generate a sync signal synchronized with the reference waveform signal; an RF module configured to generate an RF voltage signal from the reference waveform signal and apply the RF voltage signal to an RF electrode in the ion trap; an electron beam generator configured to control an operation of an ultraviolet (UV) diode for generating an electron beam injected into the ion trap according to an input control signal; and a control circuit configured to generate the control signal by using the square wave signal.

In an embodiment, when the reference waveform signal is a sine wave type, the waveform generator may convert the reference waveform signal to a sync signal of a square wave type synchronized with the reference waveform signal and when the reference waveform signal is a square wave type, the waveform generator may convert the reference waveform signal to a sync signal of a square wave type synchronized with the reference waveform signal.

In an embodiment, the sync signal may be a signal of which a voltage level for an operation control of the UV diode is adjusted.

In an embodiment, the reference waveform signal may have a single frequency in a range from about 1 MHz to about 10 MHz.

In an embodiment, the control circuit may generate the control signal for an ON or OFF operation of the UV diode in a time period in which RF trapping is performed.

In an embodiment, a square wave forming the control signal may be identical to an ON time of the UV diode and a pulse width of the sync signal is set to a value in a range from about 1 usec to about 50 msec.

In an embodiment, the control signal may be a signal synchronized with a waveform of the RF voltage signal applied to the RF electrode.

In an embodiment, the mass spectrometer may further include an ion trap module including the ion trap and configured to eject ion molecules generated by colliding the electron beam with an injected sample to an outside of the ion trap according to masses by using the RF voltage signal; a detector configured to detect ions ejected outside the ion trap; and a data analyzer configured to mass-analyze the detected ions.

In another embodiment of the present invention, an electron beam injection control method of a mass analyzer, includes: generating a reference waveform signal having one type of a square wave and a sine wave; generating a sync signal synchronized with the reference waveform signal; generating an RF voltage signal applied to an RF electrode in an ion trap on a basis of the reference waveform signal and applying the generated RF voltage signal to the RF electrode; generating a control signal by using the sync signal; and controlling an operation of a UV diode for generating an electron beam to be injected into the ion trap according to the control signal.

In an embodiment, the generating of the sync signal includes, when the reference waveform signal is a sine wave type, converting the reference waveform signal to a sync signal of a square wave type synchronized with the reference waveform signal and when the reference waveform signal is a square wave type, converting the reference waveform signal to a sync signal of a square wave type synchronized with the reference waveform signal.

In an embodiment, the sync signal may be a signal of which a voltage level for an operation control of the UV diode is adjusted.

In an embodiment, the reference waveform signal may have a single frequency in a range from about 1 MHz to about 10 MHz.

In an embodiment, a square wave forming the control signal may be identical to an ON time of the UV diode and a pulse width of the control signal may be set to a value in a range from about 1 usec to about 50 msec.

In an embodiment, the generating of the control signal may include generating the control signal in a time period in which RF trapping is performed.

In an embodiment, the control signal may be a signal of which a waveform is synchronized with the RF voltage signal.

Advantageous Effects

A mass spectrometer of the present invention may maximize an amount of electrons injected into an ion trap by electron beam injection according to a control of an operation of a UV diode for generation of an electron beam by using a signal synchronized with a signal applied to an RF electrode. In addition, the mass spectrometer may improve precision of mass analysis by maximizing an amount of electrons injected into the ion trap.

BEST MODE FOR CARRYING OUT THE INVENTION

Figure 3:
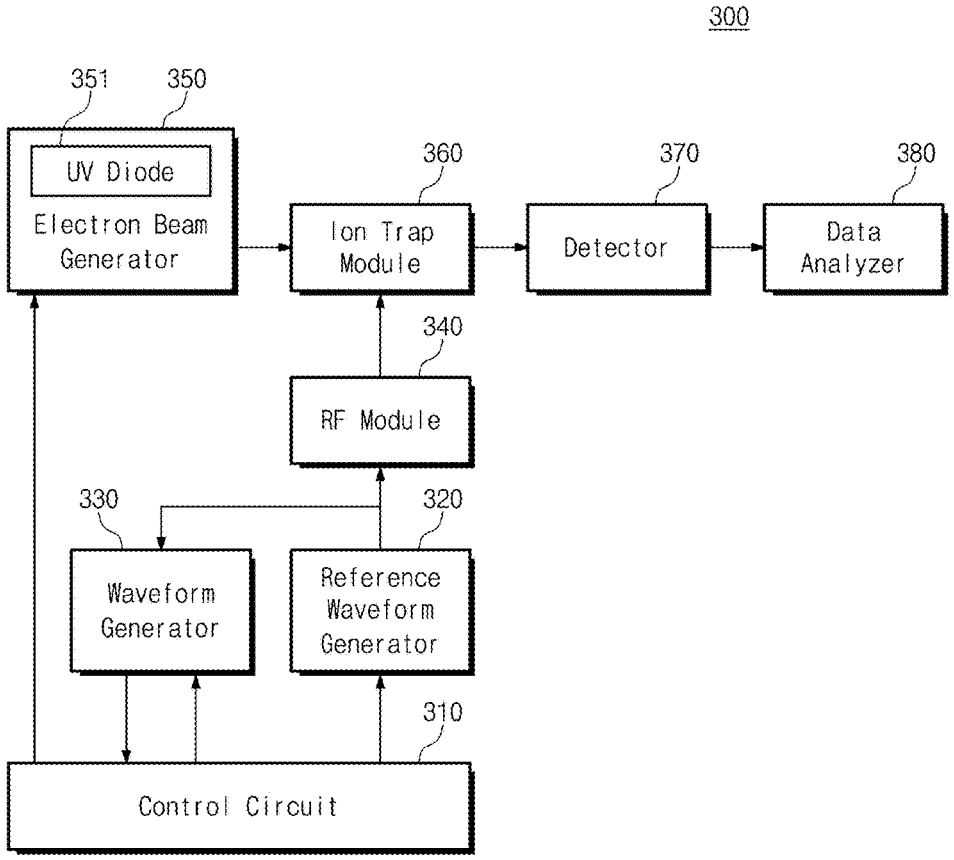
FIG. 3 is an exemplary view illustrating a mass spectrometer according to the present invention.

A drawing showing a best mode of embodiments of the present invention is FIG. 3.

MODE FOR CARRYING OUT THE INVENTION

Hereinafter, embodiments of the present invention will be described in detail with reference to the accompanying drawings. The following descriptions will be made focusing on configurations necessary for understanding embodiments of the invention. Therefore, descriptions of other configurations that might obscure the gist of the disclosure will be omitted.

The present invention provides a mass spectrometer for maximizing an amount of electrons injected into an ion trap through an electron beam control. Hereinafter the mass spectrometer will be described on the basis of the mass spectrometer using a cold electron ionization source. However, the cold electron ionization source is described for convenience of explanation and may also be used for a mass spectrometer using another source.

Figure 1:
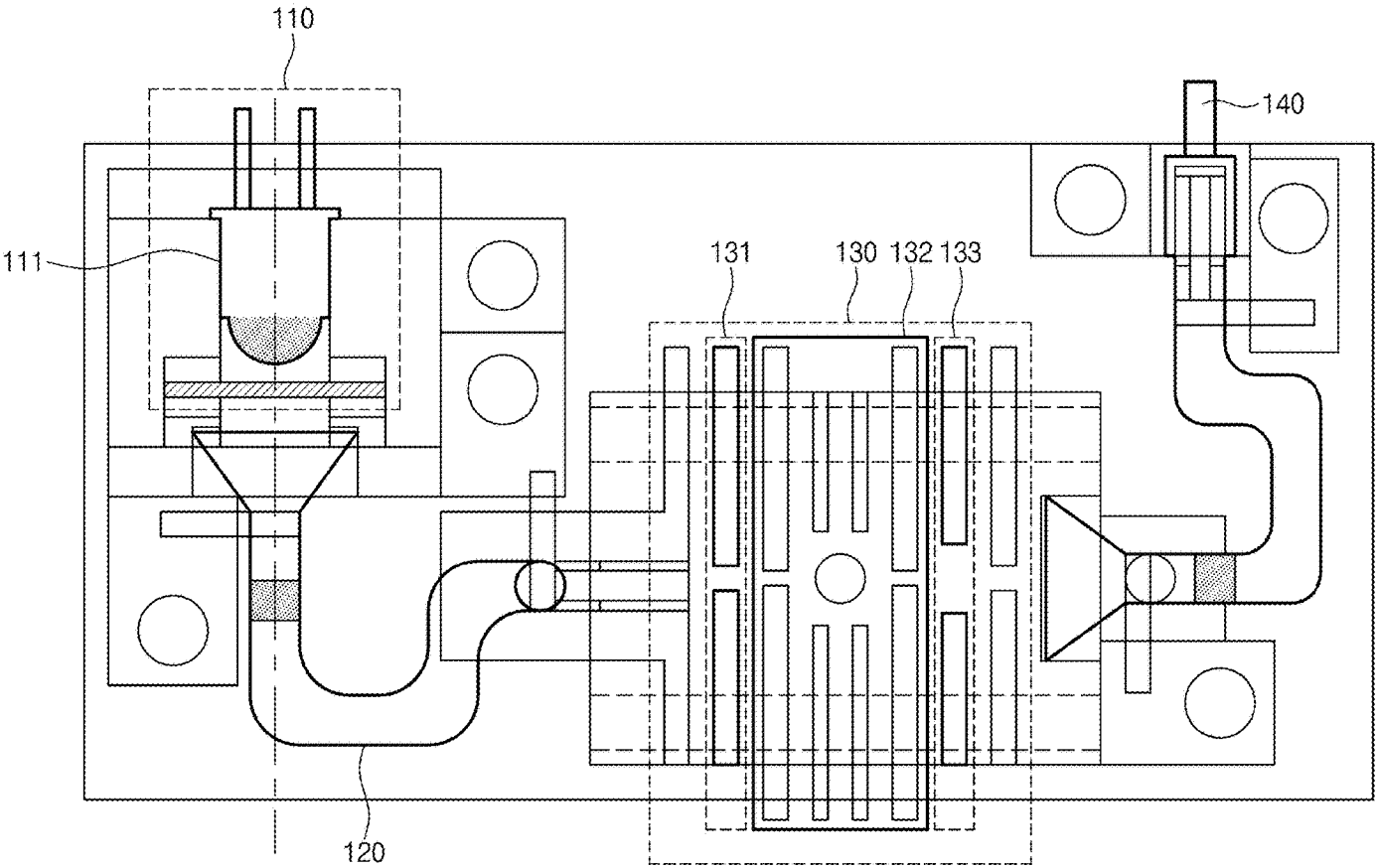
FIG. 1 is an exemplary view illustrating a mass spectrometer using a cold electron ionization source.

FIG. 1 is an exemplary view illustrating a mass spectrometer using a cold electron ionization source.

Referring to FIG. 1, a mass spectrometer 100 includes an electron beam generator 110, a Channeltorn Electron Multiplier (CEM) 120, an ion trap module 130 and a detector 140.

The electron beam generator 110 includes a cold electron ionization source. Accordingly, the electron beam generator 110 may include an ultraviolet (hereinafter 'UV') diode 111 and the UV diode 111 may form the cold electron ionization source. The electron beam generator 110 may generate electrons used as an ion source, namely, an electron beam through an operation control for the UV diode 111. The electron beam generator 110 outputs the generated electron beam as amplified electrons through the channeltron electron multiplier 120.

The channeltron electron multiplier 120 provides a path for allowing the electron beam to be injected to the ion trap module 130. The channeltron electron multiplier 120 may have a shape of a funnel for concentrating to inject electrons into the ion trap and may have an amplification function. At this point, an amplification device may be additionally positioned between the electron beam generator 110 and the channeltron electron multiplier 120.

The ion trap module 130 collides with a sample injected in advance according to application of the electron beam to generate ion molecules. Here, the injected sample is for mass analysis and may include various types such as a solid, a liquid, or a gas. The ion trap module 130 includes a lens 131, an ion trap 132, and an ion filter 133.

The lens 131 prevents an electron loss and adjusts an amount of electrons concentrated inside the ion trap 132.

The ion trap 132 provides a space for confining the ion molecules generated by the collision of the sample with the electron beam, separates the electrons according to their masses to eject the ion molecules. To this end, the ion trap 120 receives an RF voltage signal and ejects the ion molecules to the outside by the RF voltage signal.

The ion filter 133 may be, for example, a Quadrupole ion filter. At this point, the ion filter 133 may eject electrons outside the ion trap 132 by an applied voltage and remove noise through prevention of secondary ionization phenomenon.

The detector 140 detects ion molecules ejected from the ion trap module 130.

Here, a structure of the mass spectrometer having the cold electron ionization source has been exemplarily described, but is not limited thereto.

Figure 2:
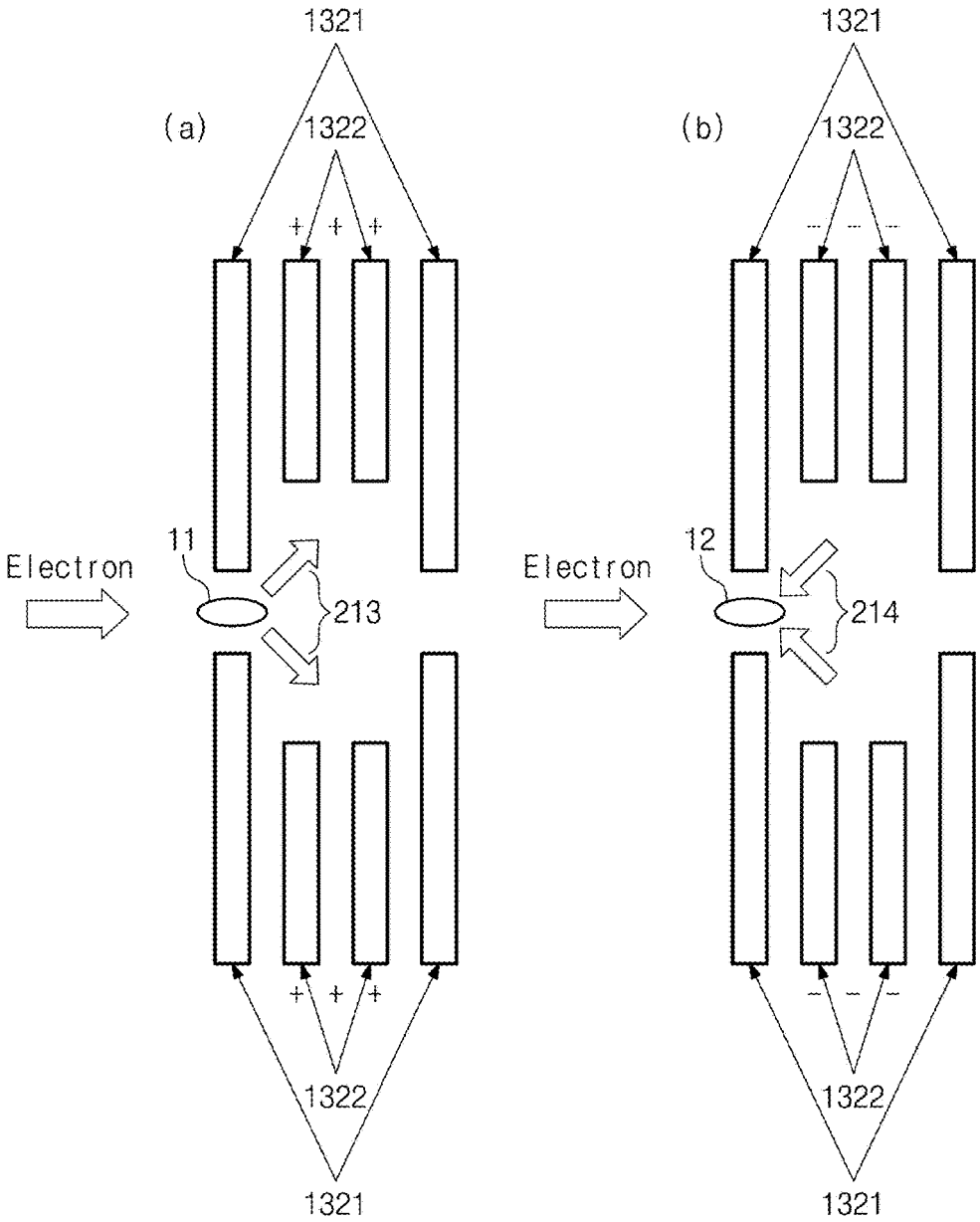
FIG. 2 is exemplary view illustrating an influence on an electron, which is exerted by an electric field formed according to a voltage applied to an RF electrode of an ion trap.

FIG. 2 is exemplary view illustrating an influence on the electrons, which is exerted by an electric field formed according to a voltage applied to an RF electrode of the ion trap.

Referring to FIG. 2, the ion trap 132 includes ion trap electrodes 1321 that are ground electrodes, and RF electrodes 1322 to which an RF voltage is applied.

(a) illustrates an electric force (or electric influence) 213 applied to an electron 11, when a positive (+) voltage is applied to the RF electrodes 1322. At this point, when the positive voltage is applied to the RF electrodes 1322, the electric force increases in a direction that the electron is flowed into the ion trap 132.

(b) illustrates an electric force (or electric influence) 214 applied to an electron 12, when a negative (−) voltage is applied to the RF electrodes 1322. At this point, when the negative voltage is applied to the RF electrodes 1322, the electric force increases in a direction that the electron is ejected out from the ion trap 132. At this point, a loss of the electron injected into the ion trap 132 occurs.

To this end, the present invention proposes a mass spectrometer synchronized with positive and negative changes of a squire wave or sine wave signal applied to the RF electrodes 1322 to inject electrons, namely, an electron beam. Through this, the proposed mass spectrometer may prevent a loss according to the electron injection in the same situation as when a negative voltage is applied to the RF electrodes 1322.

FIG. 3 is an exemplary view illustrating a mass analysis according to the present invention.

Referring to FIG. 3, the mass spectrometer 300 includes a control circuit 310, a reference waveform generator 320, a waveform generator 330, an RF module 340, an electron beam generator 350, an ion trap module 360, a detector 370, and data analyzer 380.

Here, the electron beam generator 350 includes a UV diode 351 for generating an electron beam. For example, the UV diode 351 may include a UV organic Light Emitting Diode (LED).

The control circuit 310 may be implemented with a Field Programmable Gate Array (FPGA). The control circuit 310 controls an operation of the reference waveform generator 320 in order to generate a reference waveform signal having one type of the square wave and sine wave.

When a reference waveform signal having the square wave type is input to the waveform generator 330, the control circuit 310 controls an operation of the waveform generator 330 in order to generate a sync signal having a voltage level for an operation control of the UV diode 351.

When the reference waveform signal having the square wave is input to the waveform generator 330, the control signal 310 controls an operation for converting the reference waveform signal to a sync signal of a square wave type. At this point, the control circuit 330 controls an operation of the waveform generator 330 such that a voltage level of the sync signal converted to the square wave type has a voltage level for the operation control of the UV diode 351.

In addition, the control circuit 310 generates a control signal for controlling an on or off timing of an operation of the UV diode 351 for generating an electron beam on the basis of the sync signal output from the waveform generator 330. Here, the sync signal is a signal synchronized with the square wave or the sine wave generated from the reference waveform generator 320. Through this, the control signal 310 controls a time and a period at which a control signal for the operation control of the UV diode 351 is generated.

The reference waveform generator 320 may be implemented with a Direct Digital Synthesis (DDS) Integrated Circuit (IC). The reference waveform generator 320 generates a reference waveform signal, for example, a reference waveform signal of a square wave or sine wave type for generating an RF voltage signal under a control of the control circuit 310 and outputs the reference waveform signal to the RF module 340 and the waveform generator 330. In addition, the reference waveform generator 320 may generate the reference waveform signal corresponding to a frequency band set under a control of the control circuit 310. For example, the reference waveform signal may have a single frequency in a range from about 1 MHz to about 10 MHz.

The waveform generator 330 generates, from the reference waveform signal, a sync signal configured of a square wave having the same frequency as the reference waveform signal and synchronized with the reference waveform signal under a control of the control circuit 310. At this point, the sync signal has the same pulse width as an ON time of the UN diode 351 and the pulse width has a value in a range from about 1 microsecond (usec) to about 50 milliseconds (msec).

When receiving the reference waveform signal of the square wave type, the waveform generator 330 adjusts a voltage level of the reference waveform signal of a square wave type to generate the sync signal. For example, when the voltage level of the reference waveform signal is about 1.5 V, the waveform generator 330 may adjust the voltage level to about 10 V for operation of the UN diode 351.

When receiving the reference waveform signal of the sine wave type, the waveform generator 330 converts the reference waveform signal of the sine wave type to that of the square wave type and generates the sync signal through the voltage level adjustment. For example, when the waveform generator 320 receives a sine wave during an ON operation according to an enable operation control of the control circuit 310 and a comparison voltage is set through a comparator etc. such that when the received waveform is greater than 0 V, the waveform generator 320 is to be ON and when the received waveform is smaller than 0 V, the waveform generator 320 is to be OFF, a sync signal (square wave) synchronized with the reference waveform signal (namely, the sine wave) is generated.

The sync signal generated in the waveform generator 320 has the same frequency as the reference waveform signal.

Through this, the waveform generator 320 generates the sync signal synchronized with a waveform of the RF voltage signal from the electron beam generator 350. As the waveform generator 322 outputs the sync signal to the control circuit 310, an ON or OFF operation timing of the UV diode 351 in the electron beam generator 350 is synchronized with the RF voltage signal output from the RF module 340.

The RF module 340 generates an RF voltage signal based on the reference waveform signal and applies the RF voltage signal to the RF electrode inside the ion trap module 360. At this point, the RF voltage signal has a positive (+) voltage and a negative (−) voltage based on the reference waveform signal.

The electron beam generator 350 controls the ON or OFF timing of the operation of the UV diode 351 by a control signal output from the control circuit 310. Through this, the electron beam generator 350 may generate an electron beam and injects the generated electron beam to the ion trap in the ion trap module 360.

The ion trap module 360 may have a similar structure to the ion trap module 130 of FIG. 1 and a detailed description for the ion trap module 360 refers to FIGS. 1 and 2. At this point, the ion trap module 360 ejects, to the outside by application of the RF voltage signal, the ion molecules generated through collision of a sample injected in advance with the electron beam.

The detector 370 detects ion molecules ejected from the ion trap module 360. The detector 370 outputs a detection result of detecting the ion molecules to the data analyzer 380.

The data analyzer 380 mass-analyzes the ion molecules by using the detection result for the ion molecules. For example, an analysis result received from the data analyzer 380 may be a spectrum type. The data analyzer 380 may measure a mass of an ionized sample through a spectrum analysis.

The present invention controls the operation of the UV diode 351 using the square wave signal synchronized with the sine wave signal for generation of the RF voltage signal through the waveform generator 322. Through this, the electron beam injected into the ion trap and the RF voltage signal applied to the RF electrode of the ion trap are mutually synchronized to maximize an amount of electrons injected to the ion trap according to the electron beam injection.

Figure 4:
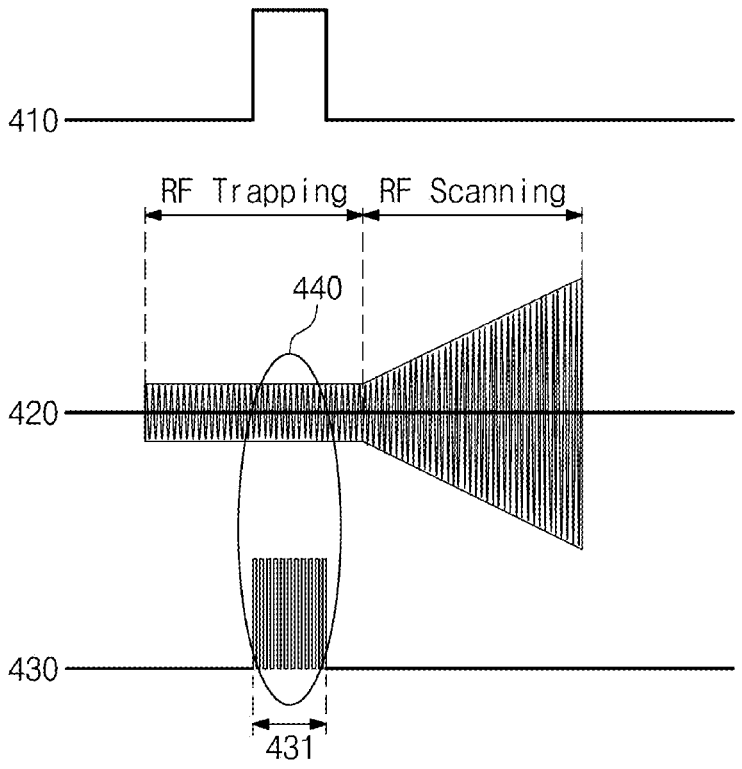
FIG. 4 is an exemplary view illustrating a signal generated through the waveform generator of FIG. 3.

FIG. 4 is an exemplary view illustrating a signal generated through the waveform generator of FIG. 3.

Referring to FIG. 4, a first signal 410 is an existing signal for operating the UV diode 351 for electron beam generation and is a pulse signal.

A second signal 420 is a reference waveform signal of a sine wave generated from the reference waveform generator 321 and is configured of an RF trapping period and an RF scanning period. The RF trapping period is a period in which the reference waveform signal of a sine wave type having a constantly maintained amplitude is output and the RF scanning period is a period in which a reference waveform signal of a sine wave type having a gradually increasing amplitude is output.

A third signal 430 is a signal generated from the waveform generator 300 for controlling an operation timing of the UV diode 351 to be ON or OFF in an operation period 431 of the UV diode 351, and is a square wave signal formed of a square wave. The square wave signal period 431 is an operation period of the UV diode 351.

In particular, the control circuit 310 proposed in the present invention controls the waveform generator 330 to be able to generate a control signal for operating the UV diode 351 in the RF trapping period of the reference waveform signal having the sine wave type.

In this way, the present invention reduces a loss of electrons injected into the ion trap by using the third signal 430 synchronized with a waveform of the RF voltage signal applied to the RF electrode, instead of the first signal 410 in the operation of the UN diode 351.

Figure 5:
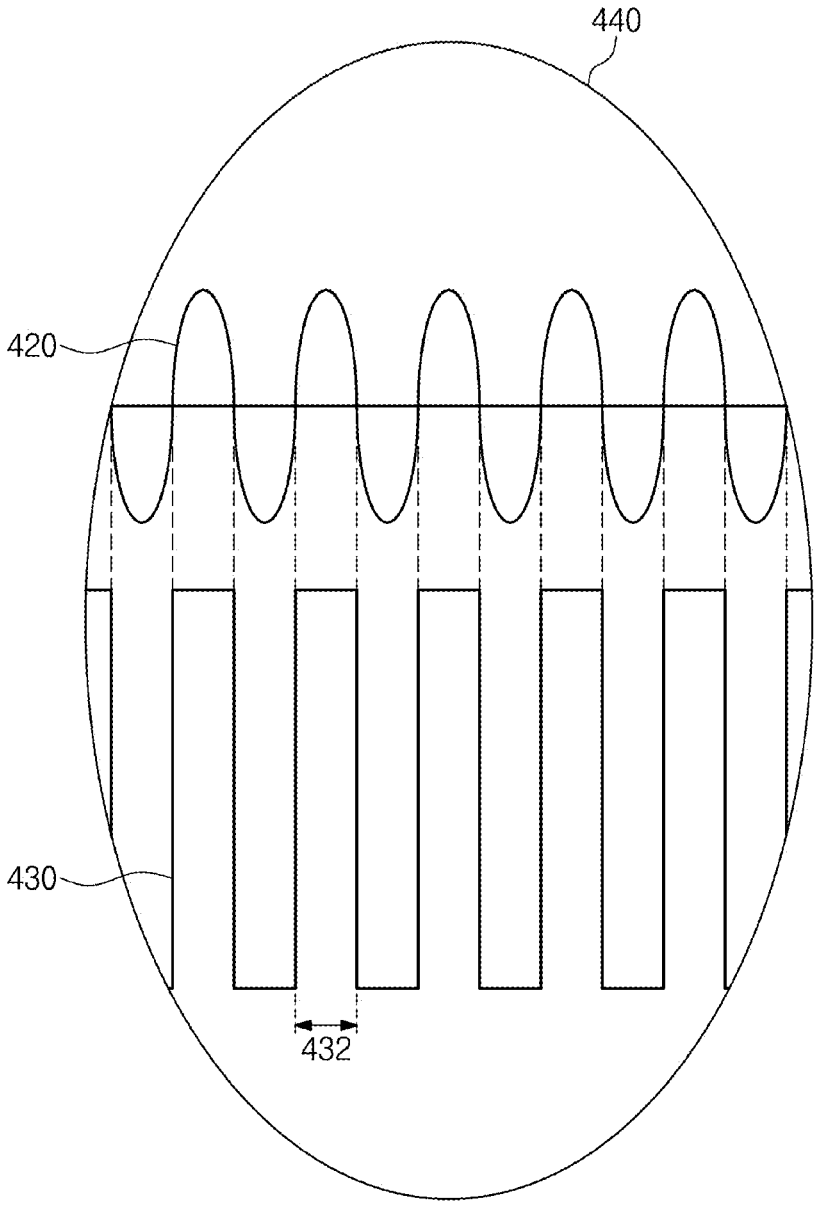
FIG. 5 is an exemplary view illustrating the second signal and the third signal illustrated in FIG. 4.

FIG. 5 is an exemplary view illustrating the second signal and the third signal illustrated in FIG. 4.

Referring to FIG. 5, the second signal 420 that is a reference waveform signal of a sine wave type and the third signal 430 that is a sync signal of a square wave type synchronized with the second signal 420 are illustrated.

At this point, the third signal 430 has a high voltage in a period where the second signal 420 is greater than 0V, and the third signal 430 has a low voltage in a period where the second signal 420 is smaller than 0 V. Through this, the third signal 430 is synchronized with the second signal 420 to be formed of a square wave signal of which a cycle and timing are identical to those of the second signal 420.

Here, the square wave 432 forming the third signal 430 is identical to the ON time of the UV diode 351 and a pulse width 432 of the third signal 430 in the square wave type may be set to a value in a range from about 1 microsecond (usec) to about 50 milliseconds (msec).

Figure 6:
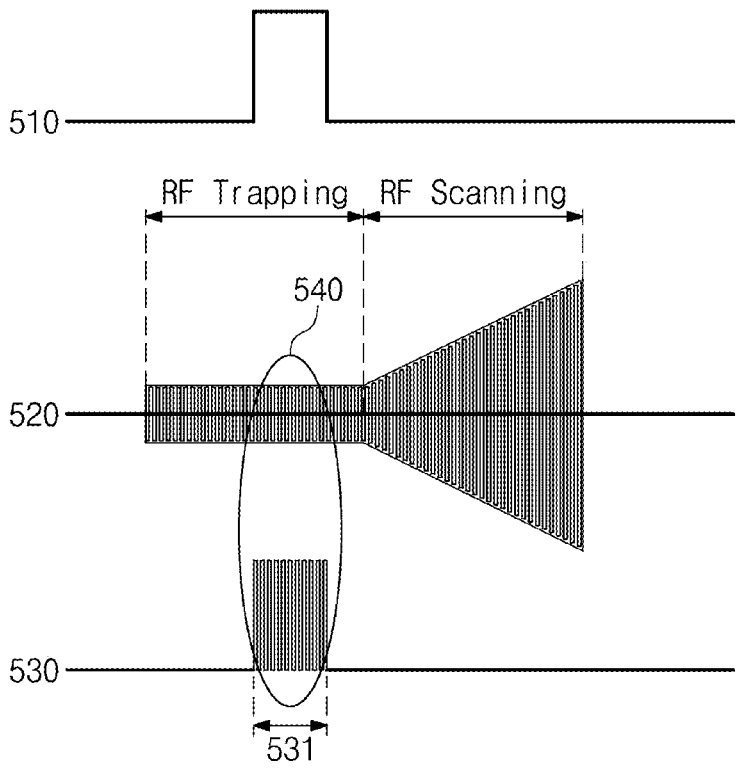
FIG. 6 is an exemplary view illustrating anther signal generated through the waveform generator of FIG. 3.

FIG. 6 is an exemplary view illustrating anther signal generated through the waveform generator of FIG. 3.

Referring to FIG. 6, a fourth signal 510 is an existing signal for operating the UV diode 351 for electron beam generation and is a pulse signal.

A fifth signal 520 is a reference waveform signal of a square wave generated from the reference waveform generator 321 and is configured of an RF trapping period and an RF scanning period. The RF trapping period is a period in which the reference waveform signal of a square wave type having a constantly maintained amplitude is output, and the RF scanning period is a period in which a reference waveform signal of a square wave type having a gradually increasing amplitude is output.

A sixth signal 530 is a signal generated from the waveform generator 330 for controlling an operation timing of the UV diode 351 to be ON or OFF in an operation period 531 of the UV diode 351, and is a sync signal formed of a square wave.

At this point, the control circuit 310 outputs, to the UV diode 351, a control signal for controlling an output time and output period 531 of the sixth signal 530.

Accordingly, the output period 531 of the control signal is an operation period of the UV diode 351.

In particular, the control circuit 310 proposed in the present invention controls the waveform generator 330 to be able to generate a control signal for operating the UV diode 351 in the RF trapping period of the reference waveform signal having the square wave type.

In this way, the present invention reduces a loss of electrons injected into the ion trap by using the sixth signal 530 synchronized with a waveform of the RF voltage signal applied to the RF electrode, instead of the fifth signal 510 in, the operation of the UN diode 351.

Figure 7:
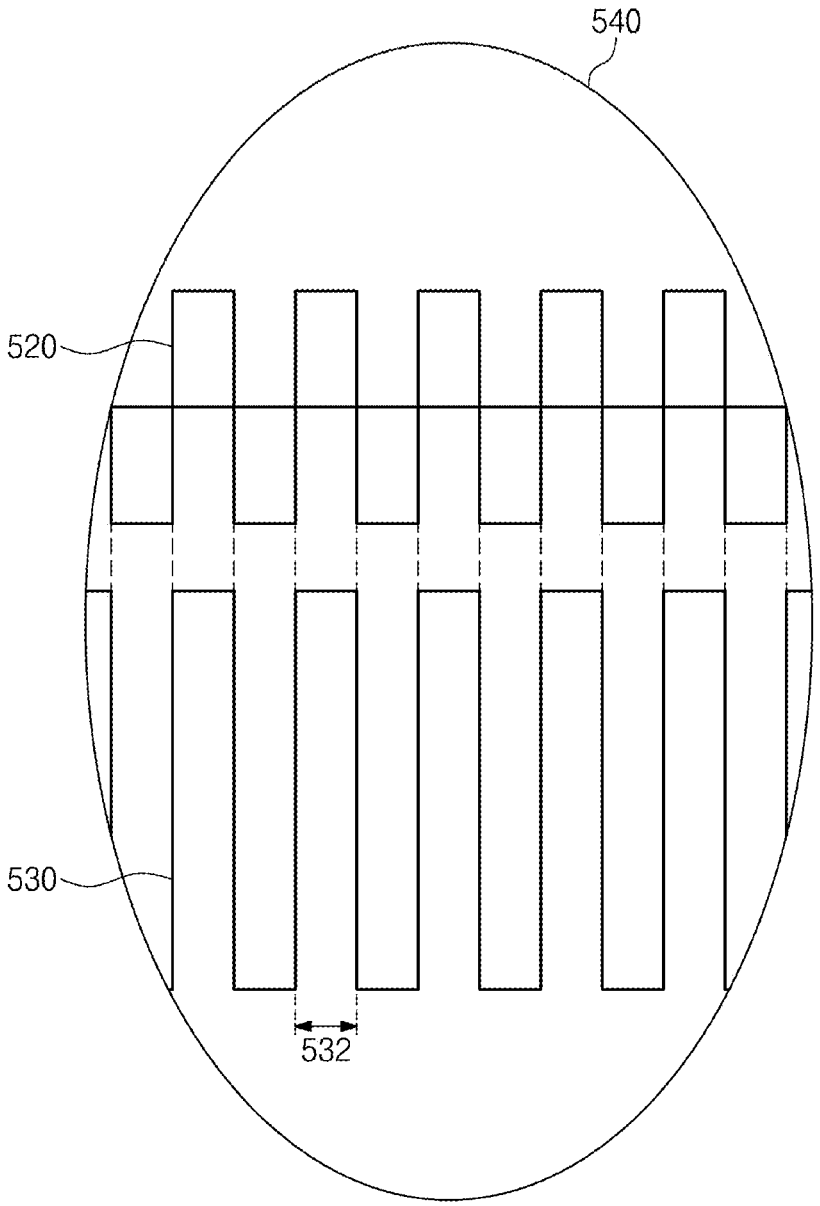
FIG. 7 is an exemplary view illustrating the fifth signal and the sixth signal illustrated in FIG. 6.

FIG. 7 is an exemplary view illustrating the fifth signal and the sixth signal illustrated in FIG. 6.

Referring to FIG. 7, the fifth signal 520 that is a reference waveform signal of a square wave type and the sixth signal 530 that is a sync signal of a square wave type synchronized with the fifth signal 520 are illustrated.

At this point, the sixth signal 530 is a signal generated through voltage level adjustment of the fifth signal 520. Accordingly, the sixth signal 530 is synchronized with the fifth signal 520 to be formed of a square wave signal of which a cycle and timing are identical to those of the fifth signal 520.

Here, the square wave 532 forming the sixth signal 530 is identical to the ON time of the UV diode 351 and a pulse width 532 of the sixth signal 530 in the square wave type may be set to a value in a range from about 1 microsecond (usec) to about 50 milliseconds (msec).

Figure 8:
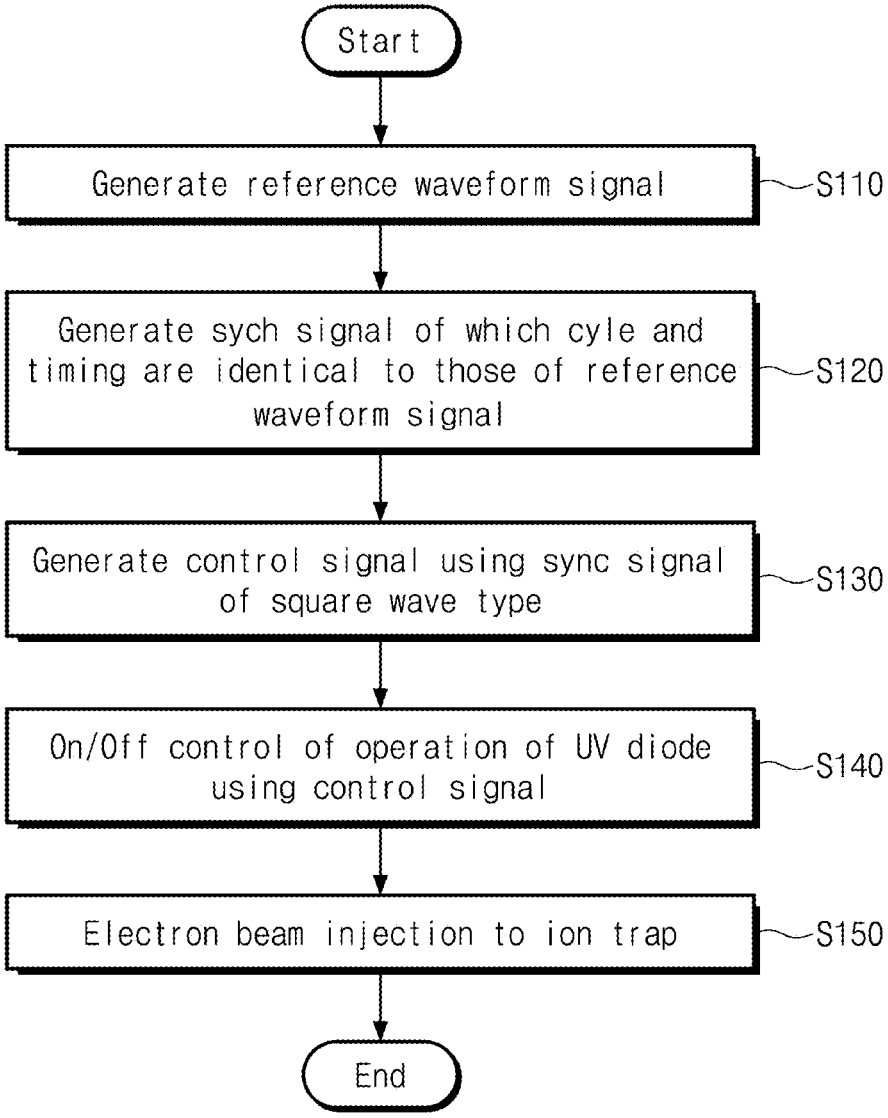
FIG. 8 is an exemplary view illustrating an operation of the mass spectrometer of FIG. 3.

FIG. 8 is an exemplary view illustrating an operation of the mass spectrometer of FIG. 3.

Referring to FIG. 8, the mass spectrometer 300 generates a reference waveform signal. Here, the reference waveform signal is a signal having one type of the square wave and the sine wave (operation S110). Here, the reference waveform signal is provided to the RF module 330 in order to generate the RF voltage signal applied to the RF electrode in the ion trap module 360 (namely, the ion trap) from the RF module 330.

The mass spectrometer 300 generates a sync signal in a square wave type of which a cycle and timing are identical those of a sine wave by using the reference waveform signal (operation S120). The mass spectrometer 300 generates a sync signal through conversion of the reference waveform signal of a sine wave type to a square wave signal synchronized with the sine wave. At this point, the mass spectrometer 300 generates a sync signal having a voltage level for an operation of the UV diode through a control of the voltage level.

The mass spectrometer 300 generates a control signal for ON or OFF of the operation of the UV diode 351 by using a sync signal in a square wave type (operation S130).

The mass spectrometer 300 controls the operation of the UV diode 351 to be ON or OFF by using a control signal (operation S140).

The mass spectrometer 300 injects the electron beam generated through the UV diode 351 to the ion trap and terminates (operation S150).

Figure 9:
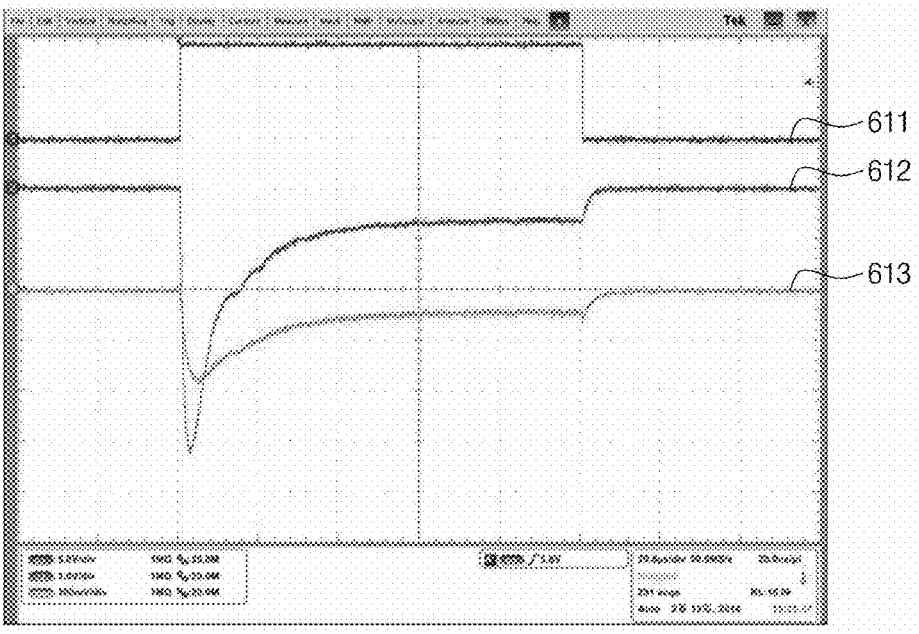
FIG. 9 is an exemplary view illustrating efficiency improvement of an electron current according to a control of electron beam generation of the mass spectrometer according to the present invention.
Figure 9:
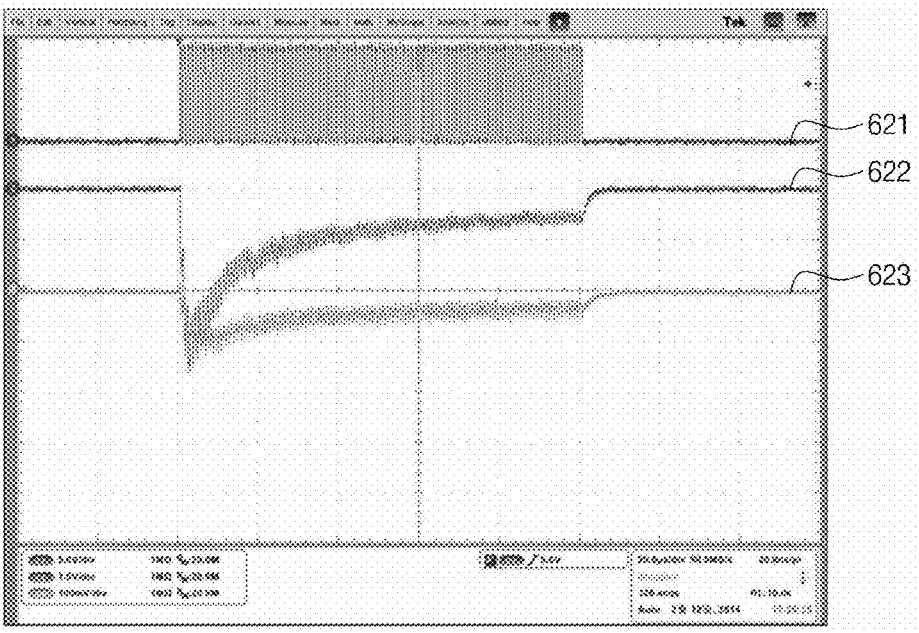

FIG. 9 is an exemplary view illustrating efficiency improvement of an electron current under a control of electron beam generation of the mass spectrometer according to the present invention.

Referring to FIG. 9, a graph obtained by measuring an electron current value at the ion trap electrodes 1321, which are the ground electrodes forming the ion trap, is illustrated.

At this point, an ion trap electrode positioned in a front surface based on a direction to which the electron beam is incident is called as an input electrode and an ion trap electrode positioned in a rear surface is called as an output electrode. At this point, the electron current value is measured based on the input electrode and the output electrode.

(a) illustrates the measured electron current value when an operation of the UV diode is controlled using a control signal that is not synchronized with the RF voltage signal. The results 611 (about 5 V/div), 612 (about 1V/div), and 613 (about 100 mV/div) of electron signal measurement at the input electrode and the output electrode are illustrated.

(b) illustrates the measured electron current value when an operation of the UV diode is controlled using a control signal that is synchronized with the RF voltage signal. The results 621 (about 5 V/div), 622 (about 100 mV/div), and 623 (about 100 mV/div) of electron signal measurement at the input electrode and the output electrode are illustrated.

Through this, it may be checked that about 70% of the electron current value increases at the input electrode and about 40% of the electron current value increases at the output electrode.

The mass spectrometer proposed in the present invention uses a signal synchronized with the RF voltage signal applied into the ion trap for an operation control of the UV diode for electron beam generation. Through this, since a large amount of electrons are injected into the ion trap according to the electron beam injection in the mass spectrometer, the mass spectrometer may minimize a loss according to the electron beam injection.

In this way, the mass spectrometer of the present invention may further improve accuracy of mass analysis by controlling the operation of the UV diode by using a signal synchronized with a waveform of the RF voltage signal.

While this invention has been described with reference to exemplary embodiments thereof, it will be clear to those of ordinary skill in the art to which the invention pertains that various modifications may be made to the described embodiments without departing from the spirit and scope of the present invention. Therefore, the scope of the present disclosure is not limited to the described embodiments but is defined by the claims and their equivalents.

INDUSTRIAL APPLICABILITY

The present invention disclosed herein relates to a mass spectrometry of a mass spectrometer, and more particularly, provides a mass spectrometer for maximizing an amount of electrons injected into an ion trap according to electron beam injection and a method for controlling electron beam injection thereof.

The invention claimed is:

1. A mass spectrometer comprising:

a reference waveform generator configured to generate a reference waveform signal having one type of a square wave and a sine wave;

a waveform generator configured to generate a sync signal synchronized with the reference waveform signal;

an RF module configured to generate an RF voltage signal from the reference waveform signal and apply the RF voltage signal to an RF electrode in an ion trap;

an electron beam generator configured to control an operation of an ultraviolet (UV) diode for generating an electron beam injected into the ion trap according to a control signal; and a control circuit configured to generate the control signal based on the sync signal, the control circuit being a circuit separate from the waveform generator.

2. The mass spectrometer of claim 1, wherein when the reference waveform signal is a sine wave type, the waveform generator converts the reference waveform signal to a sync signal of a square wave type synchronized with the reference waveform signal and when the reference waveform signal is a square wave type, the waveform generator converts the reference waveform signal to a sync signal of a square wave type synchronized with the reference waveform signal.

3. The mass spectrometer of claim 1, wherein the sync signal is a signal of which a voltage level for an operation control of the UV diode is adjusted.

4. The mass spectrometer of claim 1, wherein the reference waveform signal has a single frequency in a range from about 1 MHz to about 10 MHz.

5. The mass spectrometer of claim 1, wherein the control circuit generates the control signal for an ON or OFF operation of the UV diode in a time period in which RF trapping is performed.

6. The mass spectrometer of claim 1, wherein a square wave forming the control signal is identical to an ON time of the UV diode and a pulse width of the sync signal is set to a value in a range from about 1 microsecond to about 50 milliseconds.

7. The mass spectrometer of claim 1, wherein the control signal is a signal synchronized with a waveform of the RF voltage signal applied to the RF electrode.

8. The mass spectrometer according to claim 1, further comprising:

an ion trap module comprising the ion trap and configured to eject ion molecules generated by colliding the electron beam with an injected sample to an outside of the ion trap according to masses by using the RF voltage signal;

a detector configured to detect ions ejected outside the ion trap; and a data analyzer configured to mass-analyze the detected ions.

9. An electron beam injection control method of a mass analyzer, the electron beam injection control method comprising:

generating a reference waveform signal having one type of a square wave and a sine wave;

generating, by a waveform generator in the mass analyzer, a sync signal synchronized with the reference waveform signal;

generating an RF voltage signal applied to an RF electrode in an ion trap on a basis of the reference waveform signal and applying the generated RF voltage signal to the RF electrode;

generating, by a control circuit in the mass analyzer, a control signal by using the sync signal, the control circuit being a circuit separate from the waveform generator; and controlling an operation of a UV diode for generating an electron beam to be injected into the ion trap according to the control signal.

10. The electron beam injection control method of claim 9, wherein the generating of the sync signal comprises, when the reference waveform signal is a sine wave type, converting the reference waveform signal to a sync signal of a square wave type synchronized with the reference waveform signal and when the reference waveform signal is a square wave type, converting the reference waveform signal to a sync signal of a square wave type synchronized with the reference waveform signal.

11. The electron beam injection control method of claim 9, wherein the sync signal is a signal of which a voltage level for an operation control of the UV diode is adjusted.

12. The electron beam injection control method of claim 9, wherein the reference waveform signal has a single frequency in a range from about 1 MHz to about 10 MHz.

13. The electron beam injection control method of claim 9, wherein a square wave forming the control signal is identical to an ON time of the UV diode and a pulse width of the control signal is set to a value in a range from about 1 microsecond to about 50 milliseconds.

14. The electron beam injection control method of claim 9, wherein the generating of the control signal comprises, generating the control signal in a time period in which RF trapping is performed.

15. The electron beam injection control method of claim 9, wherein the control signal is a signal of which a waveform is synchronized with the RF voltage signal.

16. The mass spectrometer of claim 1, wherein the waveform generator is configured to generate the sync signal synchronized with the reference waveform signal such that the sync signal and the reference waveform signal has an identical cycle and an identical timing.

17. The electron beam injection control method of claim 9, wherein the generating a sync signal includes generating the sync signal synchronized with the reference waveform signal such that the sync signal and the reference waveform signal has an identical cycle and an identical timing.

* * * * *